US011332905B2

(12) United States Patent
Koivuranta

(10) Patent No.: US 11,332,905 B2
(45) Date of Patent: May 17, 2022

(54) PILE FOR A WALL

(71) Applicant: SSAB TECHNOLOGY AB, Stockholm (SE)

(72) Inventor: Tapani Koivuranta, Hämeenlinna (FI)

(73) Assignee: SSAB TECHNOLOGY AB, Stockholm (SE)

( * ) Notice: Subject to any disclaimer, the term of this patent is extended or adjusted under 35 U.S.C. 154(b) by 0 days.

(21) Appl. No.: 16/976,215

(22) PCT Filed: Mar. 12, 2019

(86) PCT No.: PCT/EP2019/056073
§ 371 (c)(1),
(2) Date: Aug. 27, 2020

(87) PCT Pub. No.: WO2019/179812
PCT Pub. Date: Sep. 26, 2019

(65) Prior Publication Data

US 2021/0002842 A1 Jan. 7, 2021

(30) Foreign Application Priority Data

Mar. 23, 2018 (EP) ..... 18163727

(51) Int. Cl.
*E02D 5/08* (2006.01)
*E02D 5/28* (2006.01)
*E02D 5/72* (2006.01)

(52) U.S. Cl.
CPC ..... *E02D 5/08* (2013.01); *E02D 5/285* (2013.01); *E02D 5/72* (2013.01)

(58) Field of Classification Search
CPC combination set(s) only.
See application file for complete search history.

(56) References Cited

U.S. PATENT DOCUMENTS 2,101,285 A * 12/1937 Stevens ..... E02D 5/30 405/278
3,688,508 A * 9/1972 Taylor ..... E02D 5/08 405/278

(Continued)

FOREIGN PATENT DOCUMENTS

JP 2002 309571 10/2002
JP 2008 169564 7/2008

(Continued)

OTHER PUBLICATIONS

International Search Report and Written Opinion dated May 31, 2019 by the International Searching Authority for International Application No. PCT/EP2019/056073, filed on Mar. 12, 2019 and published as WO 2019/179812 on Sep. 26, 2019 (Applicant—SSAB Technology AB)(11 Pages).

*Primary Examiner* — Kyle Armstrong
(74) *Attorney, Agent, or Firm* — Ballard Spahr LLP

(57) ABSTRACT

The present disclosure regards a pile for a pile wall, said pile extending longitudinally between a first and a second end and comprising at least one perimeter profile in a cross section being essentially perpendicular to the longitudinal extension of said pile, said perimeter profile enclosing an uninterrupted area in said cross section, wherein at least one section of the perimeter profile extends outwardly forming a first male connection portion, and the uninterrupted area extends into the first male connection portion, thereby forming a load bearing portion of the pile. Furthermore, the present disclosure also regards a connection arrangement and a manufacturing method.

15 Claims, 9 Drawing Sheets

(56) References Cited

U.S. PATENT DOCUMENTS 4,462,793 A * 7/1984 Maeda ..... F27B 7/34
266/173
7,470,093 B2 * 12/2008 Mansfield ..... E02B 3/066
405/284

FOREIGN PATENT DOCUMENTS

NL 23 945 C 5/2001
WO WO 2017/060567 4/2017

* cited by examiner

A - A

A - A

B - B

PILE FOR A WALL

CROSS-REFERENCE TO RELATED APPLICATIONS

This application is a U.S. National Phase Application of International Application No. PCT/EP2019/056073, filed Mar. 12, 2019, which claims priority to European Application No. 18163727.3, filed Mar. 23, 2018, each of which are hereby incorporated by reference in their entirety.

TECHNICAL FIELD

The present disclosure relates to a pile for a pile wall. Moreover, the present disclosure relates to a connection arrangement for connecting piles of a pile wall and also to a method for manufacturing a pile for a pile wall.

BACKGROUND

Pile walls are well known for being used as retaining walls and foundation structures. The piles of a pile wall may for example be of tubular shape and be connected by interconnecting members, such as male/female connections, hook connections etc. The walls may be used for bearing both vertical and horizontal loads and typically tubular pile walls may be able to bear larger loads than for example conventional sheet pile walls. The connecting members for connecting tubular shaped piles are commonly welded onto the tubular shaped pile.

One example of a pile wall design may be found in WO 2017/060567 A1, which discloses a pile wall made of tubular piles, wherein the piles have been connected by male/female connections. Especially, the female connection has been arranged inside the pile in order to reduce the diameter of the pile. However, the proposed design seems to be complicated and also difficult to realize in a cost-efficient manner.

SUMMARY

In view of the above, an object of the present invention is to provide an improved pile for a pile wall, a connection arrangement comprising such a pile and a method for manufacturing a pile for a pile wall.

The object has been provided by the subject matter as defined in the independent claims. Advantageous embodiments may be found in the dependent claims and in the accompanying description and drawings.

According to a first aspect, the object is provided by a pile for a pile wall, wherein the pile extends longitudinally between a first and a second end and comprises at least one perimeter profile in a cross section which is essentially perpendicular to the longitudinal extension of the pile. The perimeter profile encloses an uninterrupted area in said cross section, wherein at least one section of the perimeter profile extends outwardly, i.e. protrudes, and forms a first male connection portion, and the uninterrupted area extends into the first male connection portion, thereby forming a load bearing portion of the pile.

By the provision of the pile design as disclosed herein, an improved pile for a pile wall is provided. More specifically, by designing the pile such that at least one male connection portion is integrated into the perimeter profile of the pile as disclosed herein, an improved and more robust connection may be realized. Hence, in an example embodiment of the present invention, the at least one male connection portion is integrated into the perimeter profile, thereby forming a load bearing portion of the pile. Furthermore, the inventor has realized that a more cost-efficient pile wall may be accomplished. For example, the manufacturing process of the pile may be facilitated. Still further, due to the proposed design, less welding operations may be needed since parts of the connection arrangement of the pile wall are integrated into the pile, resulting in a simplified connection arrangement. Prior art solutions have for example proposed to use more welding connections and/or to make complicated pile/connection designs. By the present invention, drawbacks of the prior art have now been reduced or even eliminated.

The phrase "uninterrupted area" as used herein means a continuous area which is defined and limited by the perimeter profile of the pile and which is not interrupted by the pile or the pile's perimeter profile in a cross section thereof. In other words, the uninterrupted area is an area which is enclosed by an inner pile wall surface following the perimeter profile. Hence, an uninterrupted area may be regarded as one continuous area inside the pile without any interruptions/dividers which forms part of the perimeter profile. However, it shall be noted that the uninterrupted area may still be filled with or include one or more members/elements which are not part of the pile or the pile's perimeter profile, such as concrete, soil, or other members/elements as for example disclosed herein. Moreover, a load bearing portion of the pile as used herein may be defined as a portion of the pile which is intended to bear building loads to earth during use of the pile. There may be other portions of the pile, or related components, such as separate connection members, which may be welded onto the pile, which are not suited or used for bearing such loads.

Optionally, the perimeter profile may present at least one second section extending outwardly forming a second male connection portion, wherein the uninterrupted area extends into the second male connection portion, i.e. into both the first and second male connection portions or all of the male connection portions. Hence, there may be at least two male connection portions on the pile configured as disclosed herein.

Optionally, the first and second male connection portions may be located on essentially opposite sides of the perimeter profile. In other words, the first and second male connection portions may be located about 180 degrees from each other in the perimeter profile. However, the first and second male connection portions may also be located with other angles relative each other, which may result in an angled pile wall design. Still further, the pile may comprise more than two such male connection portions.

Optionally, the pile may be hollow. In other words, the pile may comprise an open space which is enclosed by the perimeter profile of the pile. The space may be empty, but it may also be filled with other materials which are not part of the pile's perimeter profile.

Optionally, at least one of the first and second male connection portions may be configured such that it presents at least one tapering profile which tapers inwardly towards a center of the cross section of the perimeter profile. The center may be defined as the mass center of the cross section of the perimeter profile. In the case the perimeter profile is circular, the center may be defined as the center point of the circle.

Optionally, at least one of the first and second male connection portions may comprise an intermediate waist portion and an outer top portion being located outwardly in respect of the intermediate waist portion. Put it differently, the pile may comprise a pile body and a male connection portion which comprises a top portion and an intermediate waist portion which is located between the top portion and the pile body. Still optionally, a length of the waist portion, as seen in a direction being essentially transverse to the outward direction of the at least one male connection portion, is smaller than a corresponding transverse length of the top portion. Thereby a male connection portion is provided which may result in an improved and robust connection to a corresponding female connection portion.

Optionally, at least one of the first and second male connection portions may extend along a substantial part of the longitudinal extension of the pile, such as at least 50%, at least 60%, at least 70% or at least 80% of the longitudinal extension of the pile, and preferably along the complete longitudinal extension of the pile. Especially, an improved connection and also facilitated manufacturing of the pile may be accomplished when at least one of the first and second male connection portions extends along the complete extension of the pile. However, as an alternative, at least one of the first and second male connection portions may also extend along a part of the pile, or even it may comprise intermediate interruptions along its extension, thereby resulting in several male connection portions as seen in the pile's longitudinal extension.

Optionally, the pile is made of metal, preferably steel or iron. The design of the pile as disclosed herein has been found to be especially advantageous when the pile is made of metal, and especially when it is made of steel. A steel pile is also known for being able to bear large loads, both in a longitudinal/vertical and in a transverse/horizontal direction of the pile and the pile wall.

Optionally, the cross section of the pile may be of tubular shape, such as an oval or circular shape. In other words, the perimeter profile of the pile may form a tubular shape, such as an oval and circular shape, when excluding the shape of the at least one male connection portion. Hence, the at least one male connection portion may deviate from the tubular shape. Such a shape may be advantageous in that it may be able to accommodate larger loads compared to other shapes, and also avoid or reduce the risk of high stress areas in the pile. Hence, according to an embodiment, a smooth perimeter profile without any unnecessary sharp corners/edges etc. may be provided and be advantageous over other possible cross sectional profile shapes, such as any regular or non-regular polygonal cross sectional profile shape having rounded corners. In addition, tubular shapes and the like, such as other smooth perimeter profile shapes, may be advantageous for manufacturing reasons.

Optionally, the perimeter profile of the pile may be of substantially uniform thickness along its perimeter. Alternatively, the thickness of the perimeter profile may vary. Just as a matter of example, the thickness may vary such that its thickest portion is up to 30% thicker than the narrowest portion of the perimeter profile.

Optionally, the portion of the uninterrupted area which extends into the at least one male connection portion may correspond to at least 30, 40, 50, 60, 70, 80 or 90% of the male connection portion's total area as seen in the cross section.

Optionally, the pile may be produced by cold forming and/or hot forming. The inventor has realized that the pile design as disclosed herein has shown to be especially advantageous when the pile is produced by these manufacturing techniques, and especially when the pile's cross sectional shape is produced by a cold forming operation.

Optionally, the pile may further comprise a drilling member which is located at one of the ends of the pile for drilling the pile into ground. Still optionally, the pile may be drilled into ground by a centric or eccentric drilling method. By providing a drilling member, which may be a separate or integrated member, at one of the ends of the pile, the pile may be installed by drilling through stones and boulders, and even into bedrock or seabed. Optionally, the drilling member may be configured as a ring member comprising a number of hard and tough drilling elements. Still optionally, a diameter of the ring member may be essentially equal to or larger than a largest diameter of the pile. As an alternative, the pile may also be driven into ground by a ramming and/or vibrating operation.

Optionally, the pile may further comprise a casing shoe located inside and/or at the end part of the pile at one of the ends of said pile. Such a casing shoe may be provided for increasing a robustness and strength of the pile at the end which is intended to be firstly put into ground. Especially, a casing shoe may advantageously be used when the pile is drilled into ground. Still optionally, the casing shoe may be formed such that it extends into at least one of the first and second male connection portions. Thereby the shape of the male connection portions may not be destroyed when the pile is driven or drilled into ground.

Optionally, the pile may comprise a longitudinal weld extending from the first to the second end of the pile. It has been found to be especially advantageous to use a longitudinal weld for generating the enclosing perimeter profile of the pile as disclosed herein. A longitudinal weld is herein referring to a weld comprising an essentially straight weld seam which extends longitudinally between the ends of the pile. Hence, this does not include a helical weld seam which may also be used for creating an enclosing pile perimeter profile.

Optionally, the pile may further comprise a pipe, such as a so called grout pipe, for injecting a second material, preferably concrete, into the ground and/or into an inner volume of the pile being defined and limited by the perimeter profile of the pile. The pipe may be located inside the inner volume of the pile or outside of the pile. For example, the pipe may be located in the area of the uninterrupted area which extends into at least one of the first and second male connection portions.

Optionally, the uninterrupted area may at least partly be filled with a second material, preferably concrete, during use of said pile.

According to a second aspect, the object is provided by a connection arrangement for connecting piles of a pile wall, which comprises at least one pile according to any one of the embodiments according to the first aspect of the invention. Moreover, the connection arrangement comprises a connection member for connecting the at least one pile to a second pile, wherein the connection member comprises at least one female connection portion for connecting the connection member to the at least one male connection portion of the at least one pile. It shall be noted that all embodiments of the first aspect of the invention are applicable to the different embodiments of the second aspect of the invention and vice versa, unless explicitly stated otherwise.

The advantages of the second aspect of the invention are largely analogous to the advantages as presented in relation to the first aspect of the invention and vice versa. For example, the connection arrangement results in a cost-efficient and robust design where a male connection portion is integrated into the perimeter profile of the pile. Hence, by integrating the at least one male connection portion into the perimeter profile of the pile as disclosed herein, less welds may be needed, facilitated manufacturing of the connection arrangement may be provided, increased robustness of the connection arrangement may be provided, improved connection between piles may be accomplished etc.

Optionally, the connection member may comprise at least one second female connection portion for connecting the connection member to the second pile. Still optionally, the connection member may be connected and/or additionally connected to the first or second pile by at least one weld.

Optionally, the connection member may be made of one piece, or alternatively it may be made of more than one piece, such as pieces which have been welded together forming e.g. two female connection portions. Still optionally, the connection member may be configured to extend along at least a part of the longitudinal extension of the piles, or alternatively it may extend along substantially the complete extension of the piles. Still further, there may be more than one connection member along the longitudinal extension of the piles.

According to a third aspect, the object is provided by a method for manufacturing a pile according to any one of the embodiments of the first aspect, wherein the pile is formed by cold forming and/or hot forming. Still optionally, the pile may be manufactured by additional steps, such as longitudinal welding, for example high frequency induction welding, other forming steps, weld trimming, cooling and testing, calibrating and shaping, oiling and cutting, inspection and marking etc.

It has been realized by the inventor that manufacturing a pile according to the present invention may lead to a reduction in production time of up to 20 times, or even more, compared to a pile comprising interlocking members which are welded onto the pile, such as a tube shaped pile. This is mainly due the new design removing, or at least reducing, the need for welding, which is a time consuming operation.

BRIEF DESCRIPTION OF DRAWINGS

Exemplifying and preferred embodiments of the present invention will now be described more in detail, with reference to the accompanying drawings, wherein.

Figure 1:
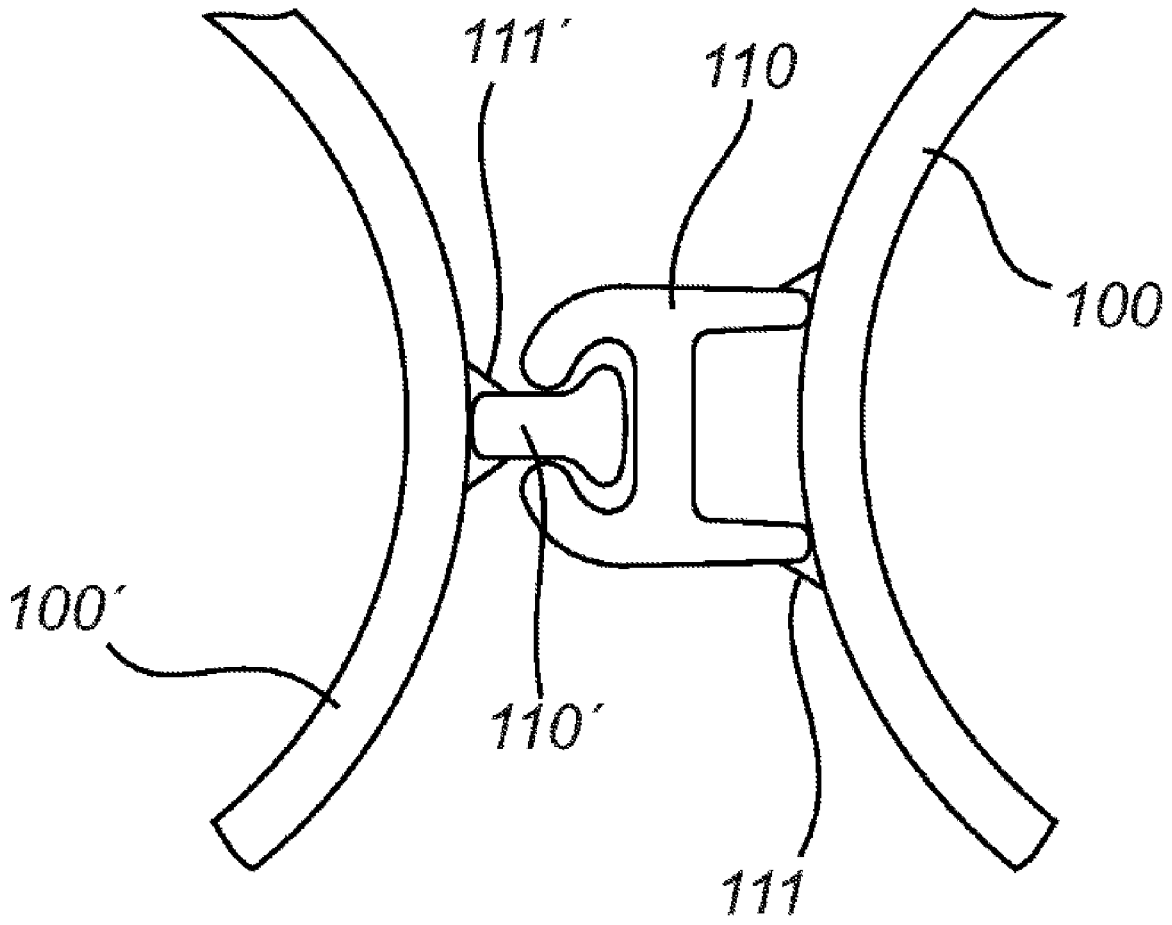
PRIOR ART FIG. 1
FIG. 1 shows a pile wall connection according to the prior art.

The drawings show diagrammatic exemplifying embodiments of the present invention and are thus not necessarily drawn to scale. It shall be understood that the embodiments shown and described are exemplifying and that the invention is not limited to these embodiments. It shall also be noted that some details in the drawings may be exaggerated in order to better describe and illustrate the invention. Like reference characters refer to like elements throughout the description, unless expressed otherwise.

DETAILED DESCRIPTION OF EXAMPLE EMBODIMENTS OF THE INVENTION

FIG. 1 concerns a prior art design of connecting piles of a pile wall. The pile wall comprises a first pile 100 and a second pile 100', wherein connection members 110 and 110', in the form of male/female connections, have been welded to the respective piles 100 and 100'. Therefore, the first pile 100 presents two welds 111 and the second pile 100' presents corresponding welds 111'. Hence, the connection members 110 and 110' are separate parts from the piles 100 and 100', respectively, and are therefore not well suited for transferring loads during use. This is due to that the welds are not strong enough and suited for transferring the loads which the pile is intended to accommodate during use. More particularly, the tubular shaped piles 100 and 100' have first been produced into tube form, in e.g. a cold forming step, whereby the connection members 110 and 110' have been joined to the respective piles 100 and 100' after the cold forming step.

Figures 2A, 2B, 2C:
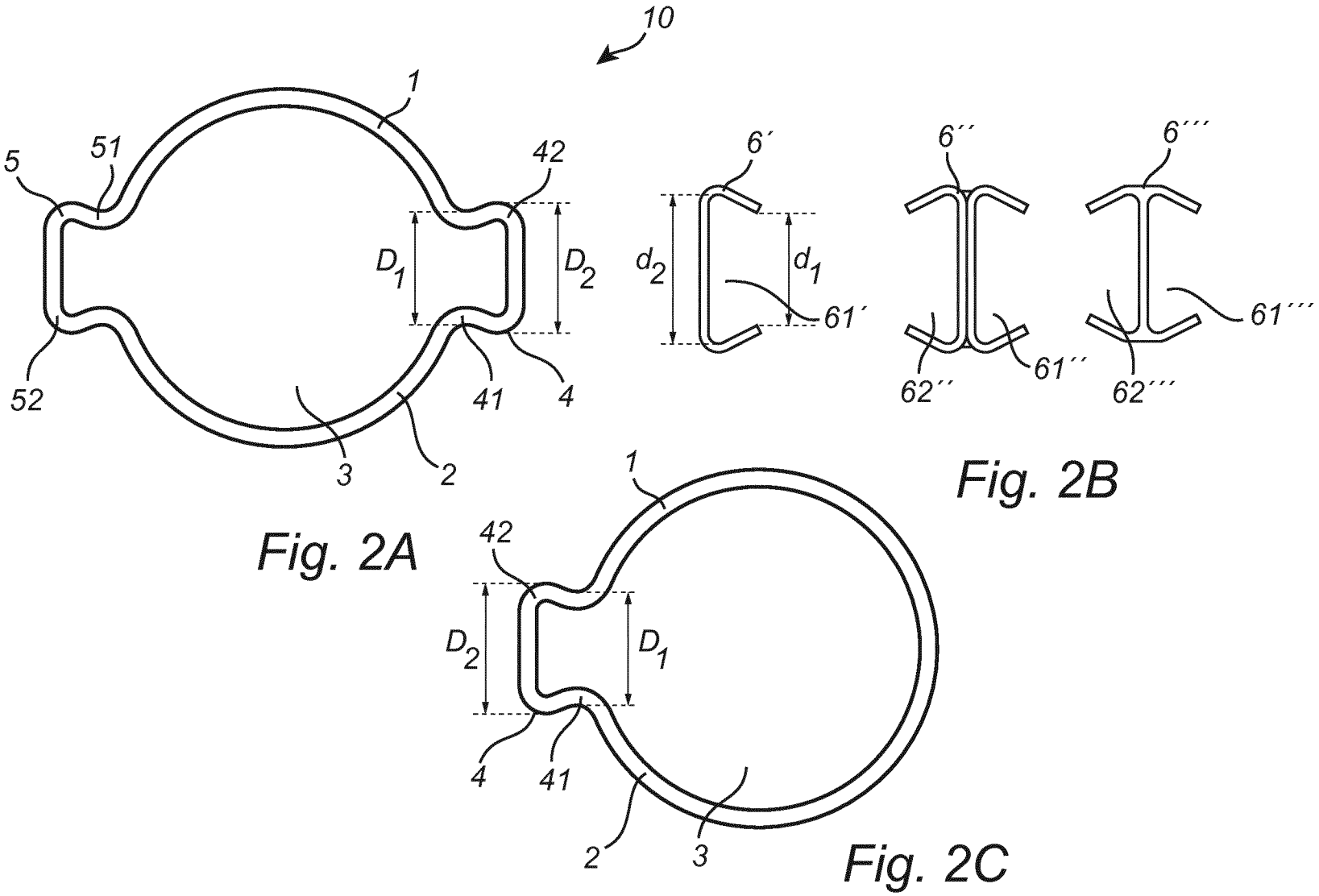
FIG. 2*a* shows a pile for a pile wall according to an example embodiment of the present invention.
FIG. 2*b* shows three different female connection members according to example embodiments of the present invention.
FIG. 2*c* shows another pile for a pile wall according to an example embodiment of the present invention.

In FIG. 2*a*, a pile 1 for a pile wall is depicted according to an example embodiment of the present invention. The figure shows a cross sectional view of a pile 1, which cross section is perpendicular to a longitudinal extension of the pile 1. The pile 1 extends longitudinally between a first and a second end and comprises at least one perimeter profile 2 in the cross section of the pile 1. The perimeter profile 2 is a load bearing part of the pile 1 intended for transferring building loads to earth for example during use and further encloses an uninterrupted area 3. Moreover, at least one section 4 of the perimeter profile 2 extends outwardly and forms a first male connection portion 4, wherein the uninterrupted area 3 extends into the first male connection portion 4. Hence, the male connection portion 4 has been integrated into the perimeter profile 2 in a way allowing a robust connection and a facilitated manufacturing process, and is a load bearing portion of the pile (1). In example embodiments, at least one of the sections 4 and 5 may extend along ½, ⅓, ¼, ⅕, ⅙, ⅐, ⅛, ⅑, 1/10 or less of the perimeter profile's perimeter. The pile 1 further comprises a second male connection portion 5 configured in a similar manner as the male connection portion 4. As can be seen, the first and second male connection portions 4 and 5 are angularly offset by about 180 degrees, i.e. they are located on essentially opposite sides of the perimeter profile 2. In this example embodiment, the first and second male connection portions 4 and 5 are configured and dimensioned in a similar manner. However, these portions could likewise be differently shaped and/or dimensioned. The first male connection portion 4 is configured as follows:

It comprises an intermediate waist portion 41 and an outer top portion 42 which is located outwardly in respect of the intermediate waist portion 41. A length $D_1$ of the waist portion 41, as seen in a direction being essentially transverse to the outward direction of the first male connection portion 4, is smaller than a corresponding transverse length $D_2$ of the top portion 42. Thereby a rigid connection may be accomplished to e.g. a connection member 6', 6" or 6'" as seen in FIG. 2*b*. The second male connection portion 5 is configured in a similar manner, i.e. it comprises an intermediate waist portion 51 and an outer top portion 52 which is located outwardly in respect of the intermediate waist portion 51. A length of the waist portion 51, as seen in a direction being essentially transverse to the outward direction of the second male connection portion 5, is smaller than a corresponding transverse length of the top portion 52. In other words, the first and second male connection portions 4 and 5 form respective tapering profiles such that they can interlock with respective and corresponding female connection members. Obviously, there are several ways of creating such male/female connections which would be realized by the skilled person. It shall be noted that the thickness of the pile's perimeter profile 2 including the thickness of the male connection portion(s) need not necessarily be uniform. However, in a preferred embodiment, the thickness of the perimeter profile 2 is substantially uniform. Moreover, a pile according to the present invention including the male connection portion(s) is preferably manufactured as a single component rather than comprising several separate elements that are connected together, by welding for example. More particularly, in an example embodiment of the present invention, the pile is made in one piece, whereby the at least one male connection portion is integrated into the pile's perimeter profile.

In FIG. 2*b*, three different types of female connection members 6', 6" and 6'" according to the present invention are depicted. The connection member 6' comprises one female connection portion 61' for connecting the connection member 6' to one of the first and second male connection portions 4 and 5 of the pile 1 as for example seen in FIG. 2*a*. The connection member 6' is configured such that a transverse length $d_1$ of an opening of the female connection portion 61' is smaller than a corresponding length $d_2$ which is located inside the opening of the female connection portion 61'. Thereby, the lengths $D_1$, $D_2$ as seen in FIG. 2*a* and the lengths $d_1$ and $d_2$, respectively, correspond to each other such that a rigid male/female connection between the pile 1 and the connection member 6' is accomplished. The pile 1 and the corresponding connection member 6' may be connected by moving the two members relative each other in the longitudinal direction thereof. In other words, the pile 1 and the connection member 6' may be connected by sliding the connection member 6' onto the male connection portion 4, or vice versa. An alternative to the connection member 6' is the connection member 6". This connection member comprises a first and a second female connection portion, 61" and 62", respectively, which are located on essentially opposite sides to each other. Thereby this connection member 6" may interconnect a first and a second pile comprising respective male connection portions. Moreover, this connection member 6" has been made by welding together two connection members which are similar to the connection member 6', forming essentially an I-shaped or H-shaped member. As an alternative, a similar connection member to 6" can be seen to the right in the figure, which shows a connection member 6'" which is made in one piece and forms essentially an I-shape or H-shape. The connection member 6'" comprises corresponding female connection portions 61'" and 62'". For all connection members, e.g. 6', 6" and 6'", the female sections may be accomplished by bending its protruding walls inwardly, thereby forming a tapering profile.

FIGS. 2*a* and 2*b* together depicts a connection arrangement 10 according to example embodiments of the present invention.

FIG. 2*c* shows another example embodiment of a pile 1 according to the present invention. The pile 1 is similar in configuration as the pile shown in FIG. 2*a*, but with the difference that the pile 1 here presents one male connection portion 4. For example, this pile 1 could be located at an end section of a pile wall. Alternatively, a connection member 6' as shown in FIG. 2*b* may be connected to the pile 1 at the side being opposite, or in any other angle, to the location of the male connection member 4, e.g. by welding.

Figure 3B:
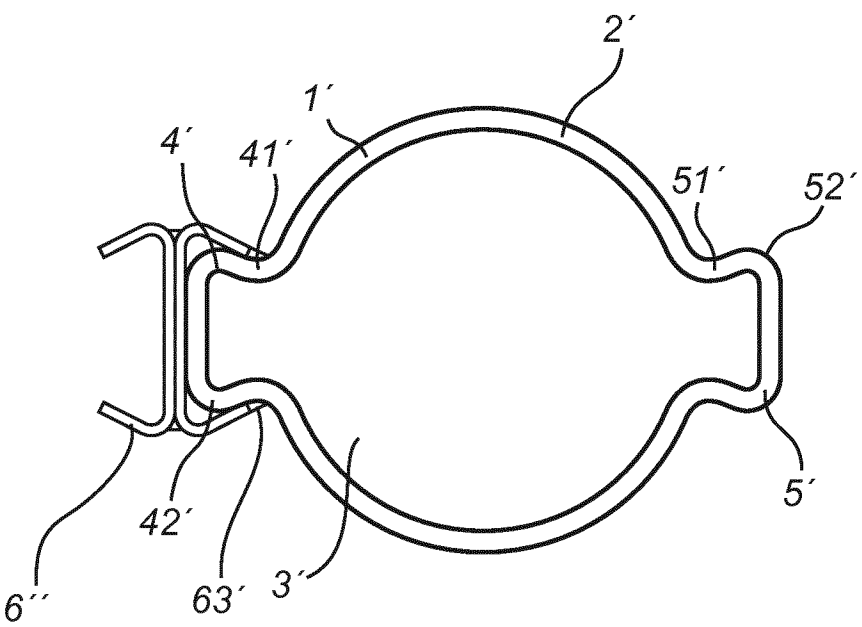
FIG. 3*b* shows a another pile for a pile wall according to an example embodiment of the present invention, which is intended to be connected to another pile as for example shown in FIG. 3*a*, 4*a* or 4*b;*
Figure 3A:
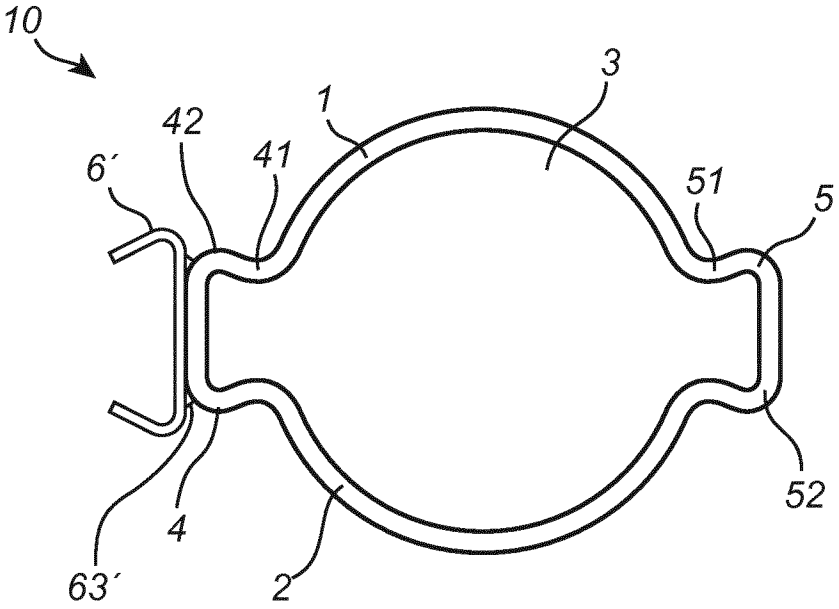
FIG. 3*a* shows a pile for a pile wall according to an example embodiment of the present invention.

In FIGS. 3*a* and 3*b*, two piles 1 and 1', an intermediate connection member 6" and an additional connection member 6' are depicted according to an example embodiment of the present invention. The pile 1 in FIG. 3*a* is similarly configured as the pile as seen in FIG. 2*a*, with the difference that the connection member 6' has been welded by a weld 63' onto the top portion 42 of the first male connection portion 4. Thereby the pile 1 may be connected to an additional pile (not shown) via the connection member 6'. Moreover, the pile 1 may be connected to the second pile 1' by its male connection portion 5 via another connection member 6". The first and the second piles 1 and 1' are in this embodiment similarly shaped, and therefore the reference numbers for the second pile 1' with the same number reference except for the apostrophe correspond to similar elements as the elements with the reference numbers of the first pile 1. Hence, these parts of the second pile 1' are not further detailed herein. The additional connection member 6" has been connected to the pile 1' via a male/female connection, 4' and 61", respectively (see also 6" in FIG. 2*b* for details). Additionally, the connection member 6" has also been welded onto the pile 1' by at least one weld 63'. Hence, in an embodiment of the present invention, at least one additional weld may be used in addition to the male/female connection for connecting the pile 1' and the connection member 6", even though it may not be necessary due to the rigid male/female connection. FIGS. 3*a* and 3*b* also depicts a connection arrangement 10 according to example embodiments of the present invention.

Figure 4A:
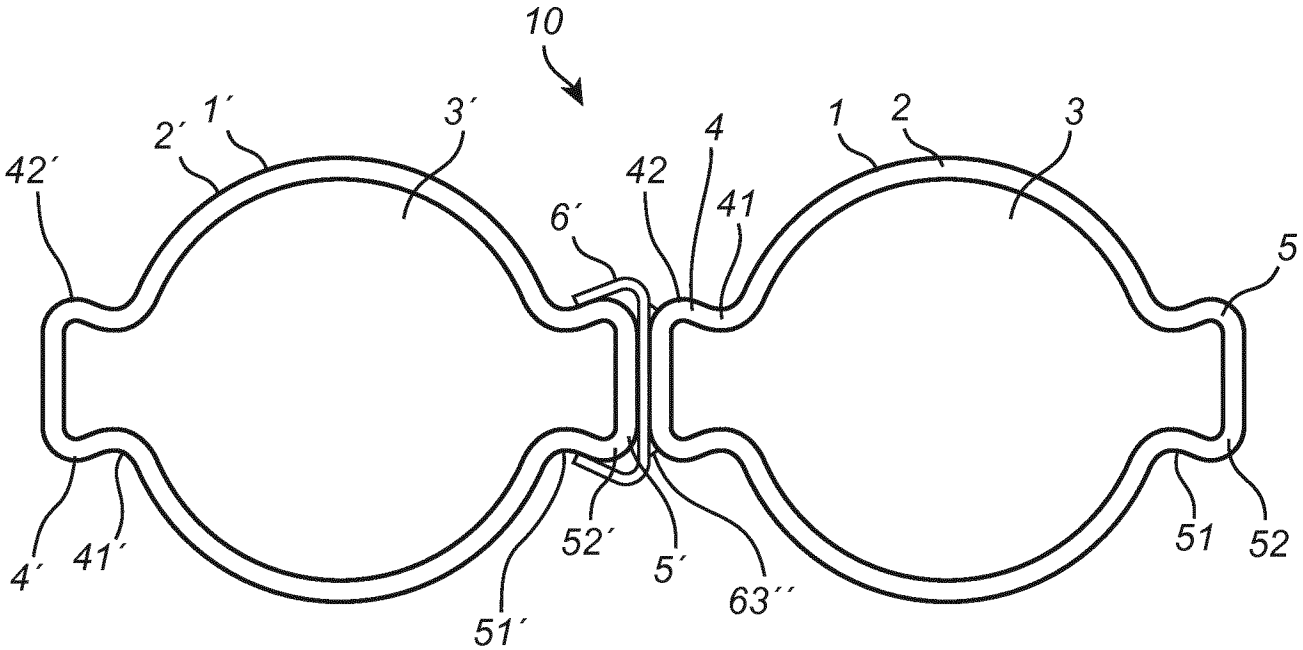
FIG. 4*a* shows a connection arrangement according to an example embodiment of the present invention.
Figure 4B:
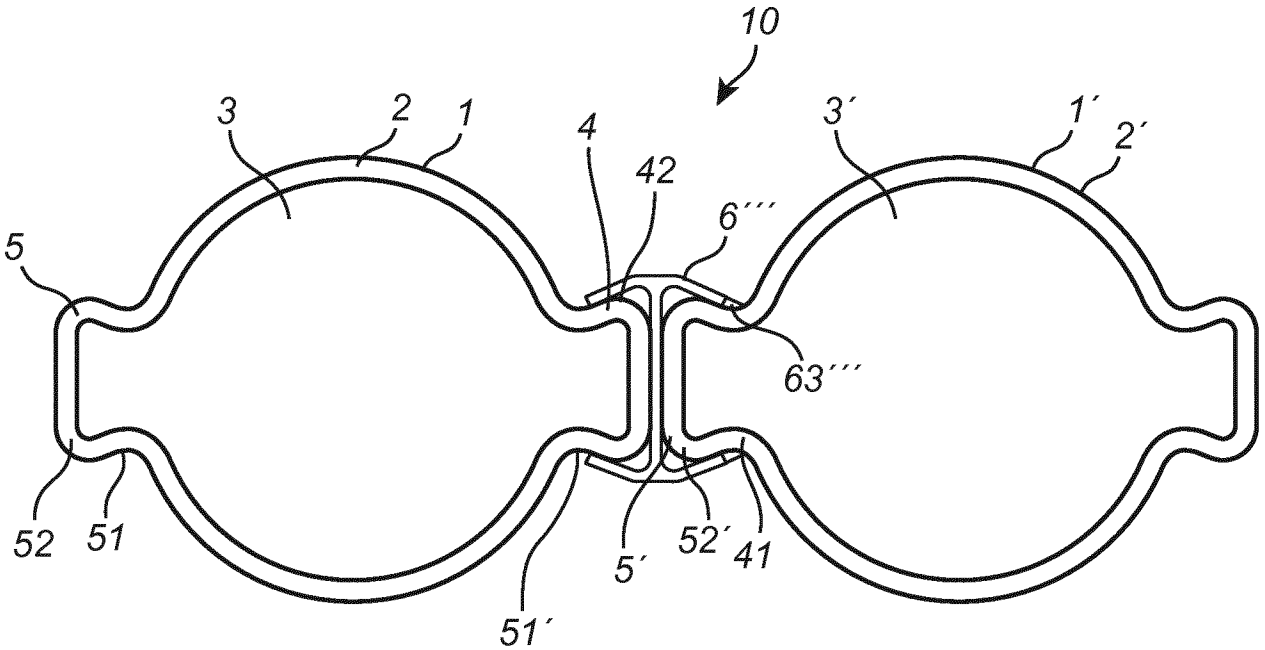
FIG. 4*b* shows another example of a connection arrangement according to an example embodiment of the present invention.

In FIG. 4*a*, two piles 1 and 1' similarly configured as the piles shown in FIGS. 3*a* and 3*b* can be seen, forming a connection arrangement 10 and a pile wall according to an example embodiment of the present invention. In this pile wall, a connection member 6' of the first kind is used and comprises one female connection portion. In FIG. 4*b*, a similar connection arrangement 10 and pile wall is depicted, with the difference that a connection member 6'" of the third kind is used. It shall be noted that a pile wall with several connections may use any one, including a combination, of the different kinds of connection members as disclosed herein. As can be further seen in FIG. 4*b*, the connection member 6'" has also been connected to the pile 1' by a weld 63'" in addition to the male/female connections. This may further strengthen the connection. For all these additional welds, as disclosed in relation to FIGS. 3*a*, 3*b*, 4*a* and 4*b*, it may be noted that they may not need to comprise weld seams which extend along the complete extension of the pile. Rather, and more preferably, shorter welds may be made, such as providing welding dots or points or seams along the pile's extension. Thereby, less time is needed in such welding steps. These welds may only be used for positioning the components relative each other and the connections between the piles are rather accomplished via the rigid mechanical male/female connection members as disclosed herein.

Figure 5A:
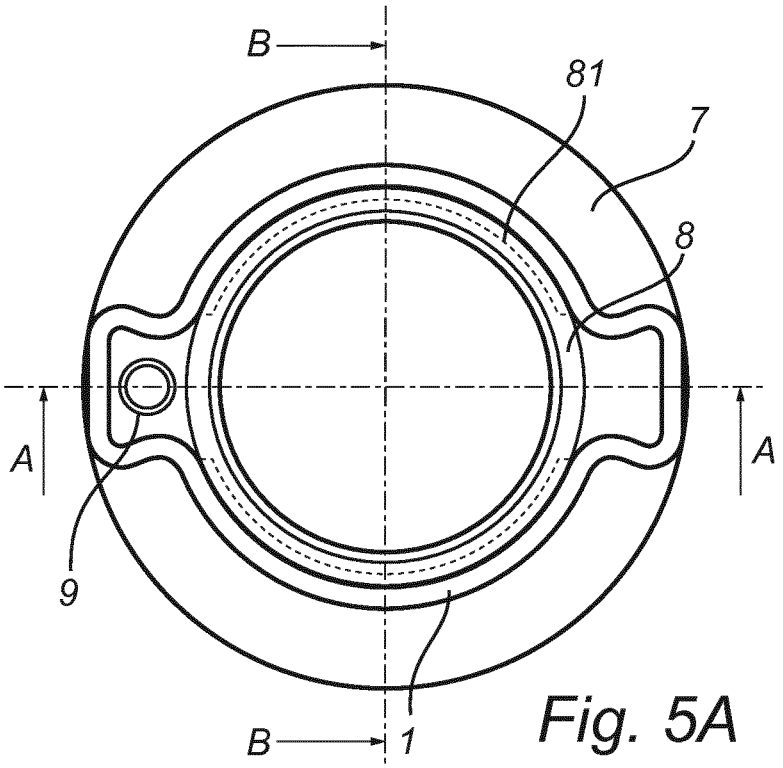
FIG. 5*a* shows another pile for a pile wall according to an example embodiment of the present invention.
Figure 5B:
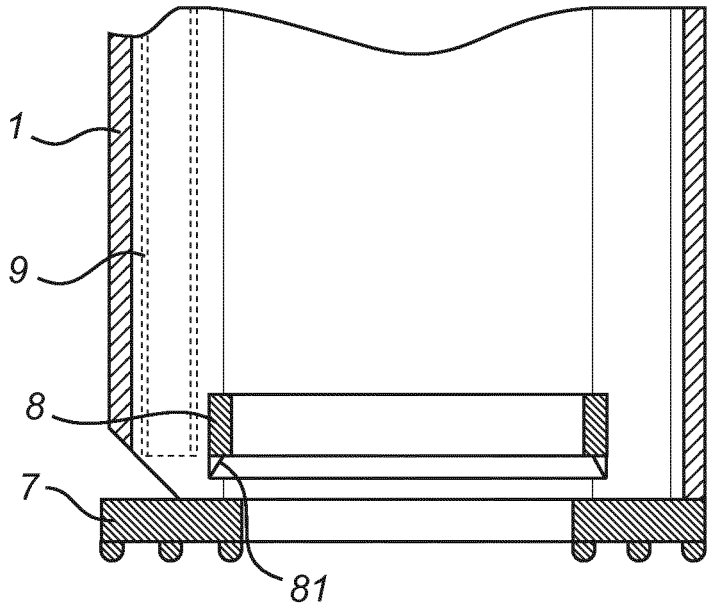
FIG. 5*b* shows an end section of a pile as seen in FIG. 5*a;*
Figure 5C:
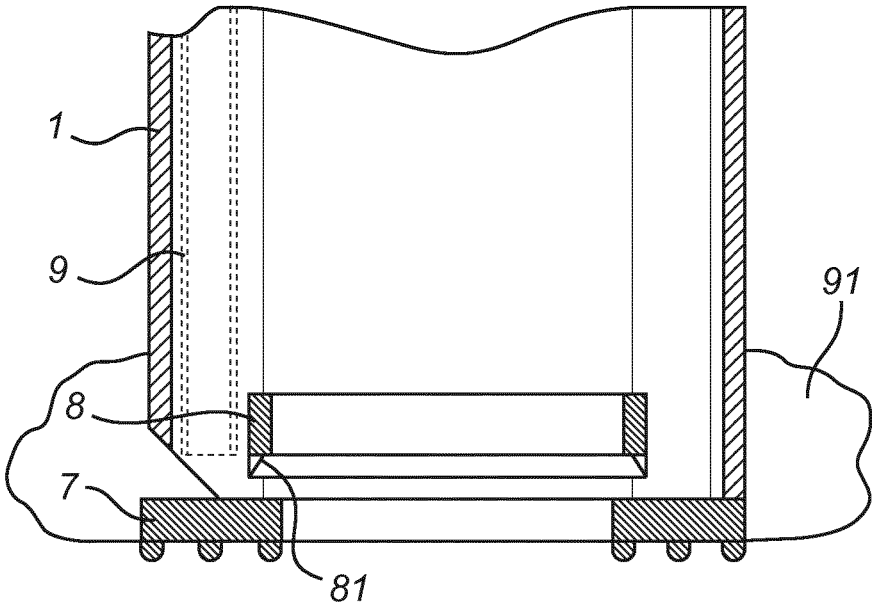
FIG. 5*c* shows the end section as shown in FIG. 5*a* with the difference that an ambient volume has been filled with an additional material.
Figure 5D:
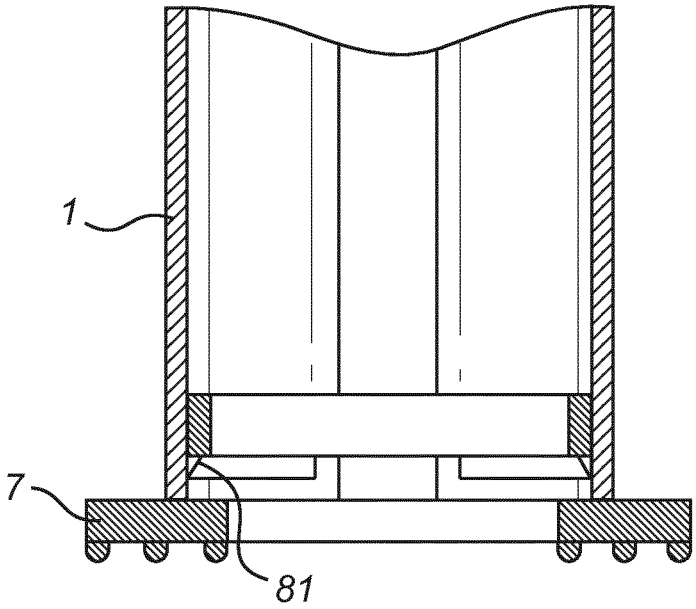
FIG. 5*d* shows another view of the end section of the pile as seen in FIG. 5*a;*

In FIGS. 5*a*-5*d* another example embodiment of a pile 1 according to the present invention is depicted. Here it can be seen that the pile 1 further comprises a drilling member 7 for drilling the pile 1 into ground. In addition, a casing shoe 8 is depicted located at one of the end sections of the pile 1. The casing shoe 8 may be used as a strengthening and reinforcing element. Still further, a pipe 9 configured as a grout pipe 9 is also provided inside the pile 1 and extends between the longitudinal end portions of the pile 1. The pipe 9 may for example be located in the inner area of one of the first or second male connection portions. FIG. 5*a* is a view of the pile 1 from above. FIGS. 5*b* and 5*c* show a cross section A-A as indicated in FIG. 5*a* of the end portion of the pile 1 which is intended to be driven/drilled into ground. FIG. 5*d* show a cross section B-B as also indicated in FIG. 5*a*. As can be seen, the casing shoe 8 may be connected to the pile 1 by a weld 81. Still further, the grout pipe 9 may be used to fill the hole where the pile 1 is located. The filler material 91 may for example be concrete or any other suitable material.

Figure 6A:
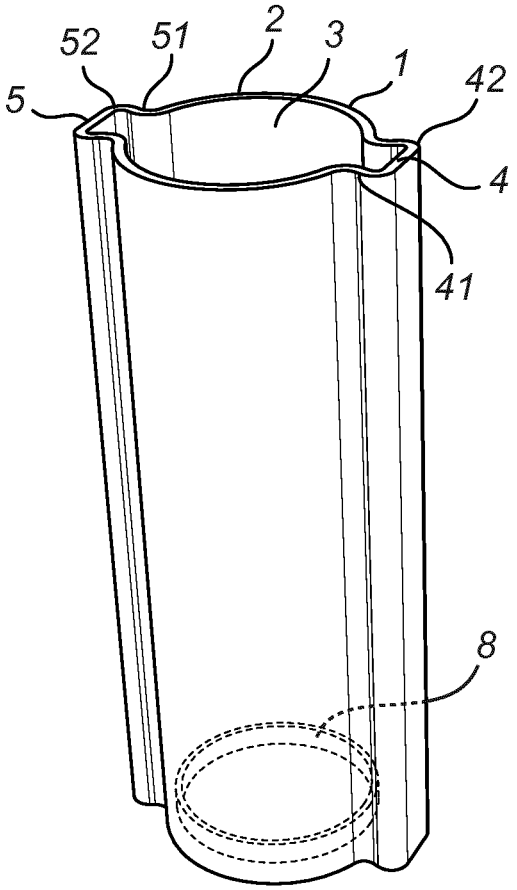
FIG. 6*a* shows a pile for a pile wall in a three-dimensional view according to an example embodiment of the present invention.
Figure 6B:
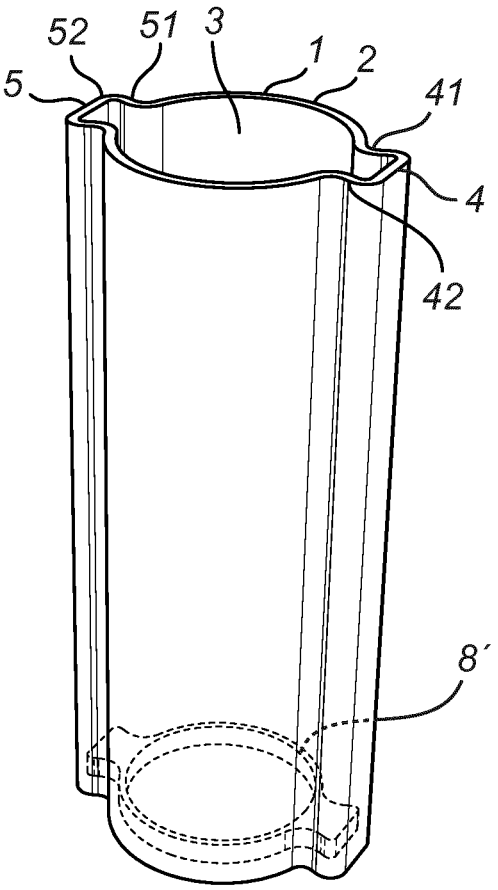
FIG. 6*b* shows another three-dimensional view of pile for a pile wall according to an example embodiment of the present invention.

FIGS. 6*a*-6*b* depict three-dimensional views of a pile 1 according to the present invention. The figures are similar with the difference that the casing shoe 8' as seen in FIG. 6*b* extends into the first and second male connection portions 4 and 5. The casing shoe 8 in FIG. 6*a* is instead formed as a ring and does not extend into the male portions 4 and 5. As can be seen, the piles 1 are hollow piles of substantially tubular shape and comprises male connection portions 4 and 5 which are integrated into the piles' perimeter profiles 2.

Figure 7:
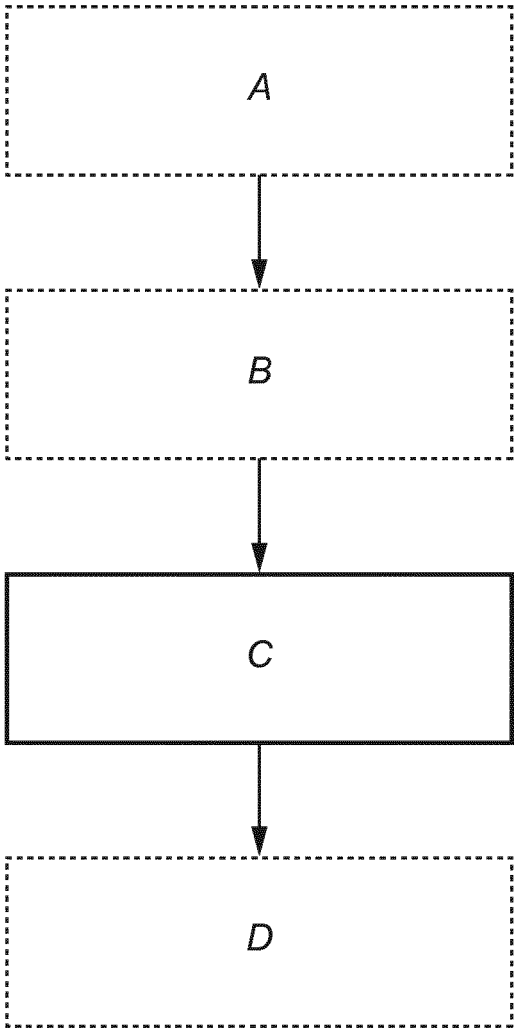
FIG. 7 shows a method for manufacturing a pile for a pile wall according to an example embodiment of the present invention.

FIG. 7 shows a flowchart of a method for manufacturing a pile according to an example embodiment of the present invention. The boxes with dashed lines indicate optional steps. Step A regards a forming step wherein the pile is formed from a sheet material into a tubular shape, by e.g. cold forming or hot forming. Step B regards a subsequent welding step where the pile is welded by a longitudinal weld thereby forming e.g. a tubular shaped perimeter profile as seen in a cross section being essentially perpendicular to the longitudinal extension of the pile. The longitudinal welding may e.g. be performed by high frequency induction welding. Step C regards a subsequent step where the pile is cold or hot formed into a shape presenting at least one male connection portion as disclosed herein. Step D regards a following step where the pile is cut into several piles and optionally oiled. Further steps may also be performed, such as final inspection and marking, cooling and testing after the welding step etc.

The invention is not limited to the embodiments described herein. It would be evident for the skilled person that other embodiments and modifications to the embodiments specified hereinabove are also possible within the scope of the claims.

The invention claimed is:

1. A pile for a pile wall, said pile extending longitudinally between a first and a second end and comprising at least one inner perimeter profile in a cross section of said pile being perpendicular to the longitudinal extension of said pile, said inner perimeter profile enclosing an uninterrupted area in said cross section, wherein at least one section of the inner perimeter profile extends outwardly forming a first male connection portion, and the uninterrupted area extends into the first male connection portion, thereby forming a load bearing portion of the pile.

2. The pile according to claim 1, wherein the inner perimeter profile presents at least one second section extending outwardly forming a second male connection portion, wherein the uninterrupted area extends into the second male connection portion.

3. The pile according to claim 2, wherein the first and second male connection portions are located on opposite sides of the inner perimeter profile.

4. The pile according to claim 2, wherein at least one of the first and second male connection portions comprises an intermediate waist portion and an outer top portion being located outwardly in respect of the intermediate waist portion.

5. The pile according to claim 4, wherein a length (D1) of the waist portion, as seen in a direction being transverse to the outward direction of the at least one male connection portion, is smaller than a corresponding transverse length (D2) of the top portion.

6. The pile according to claim 1, wherein the pile is hollow.

7. The pile according to claim 1, wherein at least one of the first and second male connection portions extends along the longitudinal extension of the pile.

8. The pile according to claim 1, wherein the pile is made of metal.

9. The pile according to claim 1, wherein the cross section of said pile is of tubular shape.

10. The pile according to claim 1, wherein the pile is produced by cold forming and/or hot forming.

11. The pile according to claim 1, wherein the pile further comprises a casing shoe located inside and/or at the end part of the pile at one of the ends of said pile.

12. The pile according to claim 11, wherein the casing shoe is formed such that it extends into at least one of the first and second male connection portions.

13. A connection arrangement for connecting piles of a pile wall, comprising, at least one pile according to claim 1, a connection member for connecting the at least one pile to a second pile, said connection member comprising at least one female connection portion for connecting the connection member to the at least one male connection portion of the at least one pile.

14. The connection arrangement according to claim 13, wherein the connection member comprises at least one second female connection portion for connecting the connection member to the second pile.

15. A method for manufacturing a pile according to claim 1, wherein the pile is formed by cold forming and/or hot forming.

* * * * *